US006241933B1

(12) United States Patent
Köll et al.

(10) Patent No.: US 6,241,933 B1
(45) **Date of Patent: *Jun. 5, 2001**

(54) PROCESS FOR THE TREATMENT OF CELLULOSIC MOULDED BODIES

(75) Inventors: Berndt Köll, Lenzing; Peter Bartsch, Nussdorf; Eduard Mülleder, Linz, all of (AT)

(73) Assignee: Lenzing Aktiengesellschaft, Lenzing (AT)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/333,837

(22) Filed: Jun. 15, 1999

Related U.S. Application Data

(63) Continuation of application No. PCT/AT98/00236, filed on Oct. 7, 1998.

(30) Foreign Application Priority Data

Oct. 15, 1997 (AU) ..... 1753/97

(51) Int. Cl.[7] ..... D02J 13/00; D06M 13/358
(52) U.S. Cl. ..... 264/340; 8/190; 264/345
(58) Field of Search ..... 264/340, 345; 8/190

(56) References Cited

U.S. PATENT DOCUMENTS

| | | |
|---|---|---|
| 3,074,814 | 1/1963 | Sause et al. . |
| 3,124,414 | 3/1964 | Dolmetsch et al. . |
| 4,246,221 | 1/1981 | McCorsley, III . |
| 6,033,443 | 3/2000 | Aeschlimann . |

FOREIGN PATENT DOCUMENTS

| | | |
|---|---|---|
| 1085492 | 7/1960 | (DE) . |
| 1141612 | 12/1962 | (DE) . |
| 1141973 | 1/1963 | (DE) . |
| 1148222 | 5/1963 | (DE) . |
| 0538977 | 4/1993 | (EP) . |
| 0553070 | 7/1993 | (EP) . |
| 0616071 | 9/1994 | (EP) . |
| 1243816 | 1/1959 | (FR) . |
| 880624 | 10/1961 | (GB) . |
| 896814 | 5/1962 | (GB) . |
| 9319230 | 9/1993 | (WO) . |
| 9749856 | 12/1997 | (WO) . |

OTHER PUBLICATIONS

Harold Lomas, Improvement in the hand of fibrous materials and sheets, Chemical Abstracts vol. 55 pp. 19263–19264 (1961).
Application for U.S. Ser. No. 09/289,317, filed Apr. 9, 1999.
Application for U.S. Ser. No. 09/633,409, filed Sep. 15, 2000.
Application for U.S. Ser. No. 09/289,316, filed Apr. 9, 1999.

*Primary Examiner*—Leo B. Tentoni
(74) *Attorney, Agent, or Firm*—Baker Botts L.L.P.

(57) ABSTRACT

The invention relates to a process for the treatment of cellulosic moulded bodies which are formed from a solution of cellulose in an aqueous tertiary amine oxide, particularly fibers, whereby the moulded bodies are brought into contact with an aqueous solution of a textile auxiliary agent which bears two reactive groups in the alkaline milieu. The invention is characterised in that as the textile auxiliary agent, a compound of formula

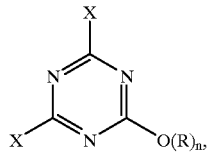

whereby X is halogen, R=H or an ionic residue and n=0 or 1, respectively a salt of this compound is used. The invention also relates to the use of compounds of this formula to reduce the tendency to fibrillate and to increase the UV absorption of solvent-spun fibers.

9 Claims, No Drawings

PROCESS FOR THE TREATMENT OF CELLULOSIC MOULDED BODIES

This is a continuation of copending application Ser. No. PCT/AT98/00236 filed Oct. 7, 1998 which is incorporated by reference herein.

The invention relates to a process for the treatment of cellulosic moulded bodies whereby the moulded bodies are contacted with an aqueous solution of a textile agent having two reactive groups in alkaline medium.

BACKGROUND OF THE INVENTION

In the last few decades intensive efforts were undertaken to produce alternative environmentally-friendly processes as a result of the environmental problems associated with the well-known viscose process. One of the most interesting things to take shape in the recent past was the possibility to dissolve cellulose in an organic solvent without the formation of a derivative and to extrude moulded bodies from this solution. Fibres spun from solutions of this kind were given the generic name of Lyocell by BISFA (The International Bureau for the Standardization of Man-Made Fibres) whereby a mixture of an organic chemical and water is meant by an organic solvent. Moreover, fibres of this kind are known as "solvent spun fibres".

It has turned out that a mixture of a tertiary amine oxide and water is particularly well suited as the organic solvent for the production of Lyocell fibres respectively other moulded bodies N-methyl-morpholine-N-oxide (NMMO) is thereby principally used as the amine oxide. Other suitable amine oxides are disclosed in EP-A 0 553 070. Processes for the production of cellulosic moulded bodies from a solution of cellulose in a mixture of NMMO and water are for example disclosed in U.S. Patent Ser. No. 4,246,221 or PCT-WO 93/19230. In this respect the cellulose is precipitated from the solution into an aqueous precipitation bath. Fibres manufactured in this way are characterised by a high fibre tenacity in a conditioned and wet state, a high wet modulus and a high loop strength.

One special property of these fibres is the high propensity to fibrillate, particularly when put under strain in a wet state, such as happens for example during the washing process. Whilst this property is perfectly desirable for certain fibre applications and produces interesting effects, the workability for other purposes, such as textiles for example, which should be wash-resistant, is reduced.

Thus, no effort was spared to reduce the fibrillation behaviour with various measures.

Numerous publications deal in particular with the possibility to reduce the tendency to fibrillate of the fibres by treating these with substances which have a cross-linking effect on cellulose.

According to EP-A-0 538 977 the fibres, which can be either freshly spun or already dried, are treated in an alkaline milieu with an aqueous system which contains a chemical reagent with 2 to 6 functional groups which can react with cellulose. In EP-A-0 538 977 derivatives of cyanuric chloride, and substituted dichlortriazines in particular, are named as suitable substances. Moreover, addition products of cyanuric chloride and poly(ethylene glycol) monomethylether are used.

From EP-A-0 616 071 it is known that fibre materials containing cellulose, such as textiles for example, should be treated amongst other things with metallic salts of partial hydrolyzates of cyanuric chloride to give the textiles crease resistant and easy care properties. The use of substances of this kind to treat solvent spun fibres is not, however, mentioned.

In relation to the reduction of the tendency to fibrillate of cellulosic moulded bodies, which are shaped from a solution of cellulose in tertiary amine oxides, no publication exists to date despite numerous efforts in this field which describes the use of multifunctional textile agents the effect of which justifies the, in the main, high price of these substances.

SUMMARY OF THE INVENTION

Thus it is the task of this invention to make a process available for the treatment of cellulosic moulded bodies, which are shaped from solutions of cellulose in aqueous tertiary amine oxides, using multifunctional textile auxiliary agents, which leads to the efficient improvement of the properties of the moulded bodies as a result of using favourably priced treating substances and, in the case of fibres, of the tendency to fibrillate in particular.

This task is resolved by a process in accordance with the first part of claim 1 which is characterised in that a compound of the formula (I)

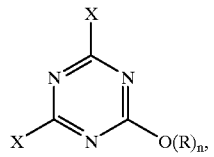

whereby X is halogen, R=H or an ionic residue and n=0 or 1, respectively a salt of this compound is used as the textile auxiliary agent. As a halogen residue X chlorine should be given preference.

Surprisingly it was shown that the textile agents used in accordance with the invention, which are relatively favourably priced, have just as great an effect or even produce a greater improvement in the properties of the moulded bodies treated as for example the substances known from EP-A 0 538 977 which are manufactured in a laborious manner. Thus it is possible to solve for example the problem of the tendency to fibrillate of solvent-spun fibres in an economic way.

In comparison to the addition products of cyanuric chloride and non-ionic residues as described in EP-A 0 538 977 the compounds according to the invention are present in ionic form in the aqueous solution in the alkaline milieu.

DETAILED DESCRIPTION OF THE PREFERRED EMBODIMENTS

Preferably a salt, particularly a metallic salt of a compound in accordance with formula (I), in which n=0, i.e. a salt of 2,4-dichloro-6-hydroxy 1.3.5-triazine, is used. Sodium, potassium or lithium salt are preferably used as the metallic salt.

It is, however, also possible to use 2,4dichloro-6-hydroxy 1.3.5-triazine as such whereby the ionic form is formed in the alkaline medium of the treatment of the moulded body.

Preferably the residues R are anionic residues, e.g. —$SO_3$ or —$C_1$–$C_6$-alkyl—$SO_3$ or $CO_2$ or—$C_1$–$C_6$-alkyl—$CO_2$. The residues R can, however, also be cationic. Residues R with e.g. —$C_{1-C6}$-alkyl—$N^+(C_1–C_4\text{-alkyl})_3$ are given preference.

In one preferred embodiment of the invention the treated cellulosic moulded bodies are never dried fibres. Solvent-spun fibres in their state before the first drying are designated as "never dried" fibres. It has been shown that the use of compounds of the formula (I) on never dried fibres in particular produces a considerable reduction in the tendency to fibrillate.

Moreover, the use of compounds of formula (I) on already dried solvent-spun fibres or textiles made of these, e.g. fabrics, warp-knitted fabrics or knitted fabrics, produces excellent results.

The pH value of the aqueous solution of the textile auxiliary agent preferably equals 12 to 14 when it is brought into contact with the moulded bodies.

In another preferred embodiment of the invention the pH value of the aqueous solution of the textile auxiliary agent is only held in a weak alkaline range from 7 to 9, e.g. from 7,5 to 8,5 and preferably from 8 to 9 when bringing into contact with the moulded bodies. Since the two reactive halogen substituents of the compounds according to formula (I) have difference reactivities, first of all a reaction of the first reactive group of the textile auxiliary agent takes place with the cellulose. The moulded bodies are then pressed and brought into contact with an alkaline aqueous solution with a pH value of 11 to 14, e.g. a pH value of 13. The reaction of the second reactive group of the textile auxiliary agent thereby takes place with the cellulose. This embodiment of the invention is described in the following as the "two-bath" process.

The advantage of this preferred embodiment of the invention is that hydrolysis of the substance in accordance with formula (I) can be put last with only weak alkaline pH values and fewer hydrolysis losses have to be taken into account. This contributes to the economic efficiency of the process.

In a preferred embodiment of the invention the moulded bodies are submitted to heat treatment during or after the bringing into contact with the aqueous solution of the textile auxiliary agent. In the case of the two bath process the heat treatment can take place during and/or after being brought into contact with the weak alkaline solution of the textile auxiliary agent as well as after the bringing into contact of the pressed moulded bodies with the stronger alkaline aqueous solution. Satisfactory results are also achieved when a heat treatment only takes place after the bringing into contact of the moulded bodies with the stronger alkaline aqueous solution. Thus the step by step reaction of both reactive groups of the textile auxiliary agent can be purposely controlled by the respective use of the heat treatment.

The invention also relates to the use of a compound of the formula (I)

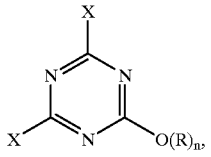

whereby X is halogen, R=H or an ionic residue and n=0 or 1, respectively of a salt of this compound to reduce the fibrillation tendency of solvent-spun cellulosic fibres.

Moreover, surprisingly it was found that compounds of formula (I) result in an increase in the UV absorption of moulded bodies from solutions of cellulose in aqueous solutions of tertiary amine oxides.

The modification of textiles to increase sun protection efficiency with certain substances designated as UV absorbers is well known (e.g. Textilveredelung 31 (1996) 11/12, 227–234). UV absorbers of this kind reduce the remission respectively the transmission of UV radiation by the textile. The UV absorbers must be carefully selected depending upon the fibre material. It has now turned out that the compounds of formula (I) work as excellent UV absorbers when using solvent-spun fibres or textiles.

The invention thus also relates to the use of a compound of the formula (I)

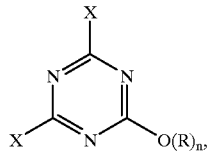

whereby X is halogen, R=H or an ionic residue and n=0 or 1, respectively of a salt of this compound to increase the UV absorption of solvent-spun cellulosic fibres.

Thus the use of one sole substance when treating solvent-spun fibres can have two desired effects, namely the reduction of the fibrillation tendency and an increase in UV absorption. A double effect of this kind was until now not known according to state of the art.

EXAMPLES

Methods of analysis:

Determining the rate of fibrillation:

The rubbing of the fibres against one another during washing procedures respectively with regard to finishing processes in a wet state is simulated by the test which follows: 8 fibres are placed with 4 ml of water in a 20 ml sample bottle and shaken for three hours in a laboratory shaking device of the type R0–10 from Messrs. Gerhardt, Bonn (Germany) at level 12. The fibrillation behaviour of the fibres is then assessed under the microscope by counting the number of fibrils for each 0.267 mm of fibre length and is indicated in terms of a fibrillation rating of 0 (no fibrils) to 6 (pronounced fibrillation).

Determining the wet abrasion value:

Twenty fibres with a length of 40 mm are placed on a metal roll with a thickness of 1 cm and weighed down with a pre-tensing weight which depends upon the decitex of the fibres. The roll is covered with a viscose filament yarn stocking and is continuously moistened. The roll is turned at a speed of 500 rotations per minute during measuring and at the same time it is turned diagonal to the fibre axis backwards and forwards whereby a pendulum movement of approximately 1 cm takes place.

The number of revolutions is measured, until the fibres are worn through. The mean value of the abrasion cycles of 20 fibres is taken as the measured value. The higher the number of revolutions, until the fibres are worn through, the better the fibrillation behaviour of the fibres.

Example 1

A dyed knitted fabric of solvent-spun fibres was brought into contact with a liquor ratio of 1:30 with an aqueous solution containing 20 g/l sodium salt of 2,4-dichloro-6-hydroxy 1.3.5-triazine, 20 g/l NaoH and 1 g/l Leonil SR (wetting agent, manufacturers: Messrs.Hoechst). The solution had a pH value of 13. The knitted fabric was impregnated with the solution for five minutes then the excess solution was pressed off with a padder at 1 bar and heat treated with steam for 5 minutes at 100° C. The knitted fabric was then repeatedly washed with a 2% acetic acid and water and then dried.

Individual fibres from the knitted fabric were prepared and submitted to a wet abrasion test according to the instruction given above. The mean value from the tests equalled 470 revolutions. This complies with a reduction in fibrillation tendency of approximately 75% compared to an untreated fibre.

Example 2

An undyed knitted fabric of solvent-spun fibres was treated as described in example 1 and submitted to a wet abrasion test. The mean value from these tests equalled 620 revolutions.

Example 3

Never dried solvent-spun cellulose fibres produced according to the process of PCT-WO 93/19230 with a titre of 3.3 dtex were impregnated in a liquor ratio of 1:25 with a solution containing 30 g/l sodium salt of 2,4-dichloro-6-hydroxy 1.3.5-triazine, 20 g/l NaOH and 30 g/l $Na_2SO_4$ for five minutes at room temperature. The solution had a pH value of 13. The fibres were subsequently heat treated for ten minutes at 110° C. with steam, washed and dried. The fibrillation rate was measured in the fibres in accordance with the instruction given above. After three hours of shaking the fibres displayed on average 9 fibrils per 0.267 mm and a fibrillation value of 2.75. Compared to this fibres not treated with the textile auxiliary agent revealed on average 12 fibrils for each 0.276 mm after three hours of shaking and a fibrillation value of 4. After 9 hours of shaking in the tester an analogous property was revealed.

In the abrasion test the treated fibres revealed a mean value of 125 revolutions whilst untreated fibres had a mean value of 13 revolutions.

Example 4

Never dried solvent-spun fibres produced according to the process of PCT-WO 93/19230 with a titre of 1.3 dtex were impregnated with a liquor ratio of 1:10 with a solution containing 30 g/l of sodium salt of 2,4 dichloro-6-hydroxy 1.3.5-triazine and 16 g/l NaOH (pH value of solution: 13) for two minutes at 20° C. The fibres were then heat treated for one minute with steam at 110° C., washed and dried. Subsequent abrasion tests were carried out on the fibres. The mean value of the wet abrasion test equalled 702 revolutions.

Example 5

Two Bath Process

Never dried solvent-spun fibres with a titre of 1.3 dtex were impregnated with an aqueous solution containing 30 g/l sodium salt of 2,4 dichloro-6-hydroxy 1.3.5-triazine with a liquor ratio for two minutes at 20° C. The aqueous solution revealed a pH value of approximately 8. Following impregnation the fibres were pressed, brought into contact with an aqueous solution containing 16 g/l NaOH (pH value of approximately 13), pressed, heat treated for two minutes at 110° C. with steam, washed and dried.

The wet abrasion test for fibres treated in this way produced a value of 270 revolutions. This complies with a reduction in the fibrillation tendency by approx. 50% compared to an untreated fibre.

Example 6

The remission of UV radiation was measured in solvent-spun fibres treated according to example 3 respectively example 4. In all cases a clear reduction in the remission value became apparent compared to untreated solvent-spun fibres. The scale of the no more remitted and thus absorbed share of UV radiation equals approx. 40%.

What is claimed is:

1. Process for the treatment of cellulosic moulded bodies shaped from a solution of cellulose in an aqueous tertiary amine oxide comprising:

providing moulded bodies providing an aqueous solution of a textile auxiliary agent, which carries two reactive groups wherein the textile auxiliary agent is selected from the group consisting of a compound having the formula

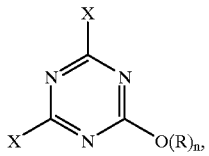

whereby X is halogen, R=H or an ionic residue and n=0 or 1, and a salt of the compound contacting the moulded bodies with the aqueous solution of the textile auxiliary agent in an alkaline medium.

2. Process according to claim 1 wherein the textile auxiliary agent is a metallic salt of the compound.

3. Process according to claim 1 wherein n=1 and R is an anionic residue and wherein the textile auxiliary agent is a metallic salt.

4. Process according to any one of claims 1, 2 or 3 wherein the cellulosic moulded bodies are never dried fibres.

5. Process according to any one of claims 1, 2 or 3 wherein the pH value of the aqueous solution of the textile auxiliary agent is from 12 to 14 when being brought into contact with the moulded bodies.

6. Process according to any one of claims 1, 2 or 3 wherein the moulded bodies are subjected to heat treatment during contact with the aqueous solution of the textile auxiliary agent.

7. Process according to claim 4 wherein the pH value of the aqueous solution of the textile auxiliary agent is from 12 to 14 when being brought into contact with the moulded bodies.

8. Process according to claim 2 wherein n=0.

9. Process according to claim 2 wherein n=1.

* * * * *

UNITED STATES PATENT AND TRADEMARK OFFICE

CERTIFICATE OF CORRECTION

PATENT NO. : 6,241,933 B1
DATED : June 15, 1999
INVENTOR(S) : Köll et al.

It is certified that error appears in the above-identified patent and that said Letters Patent is hereby corrected as shown below:

Column 1,
Line 9, "in alkaline" should read -- in an alkaline --
Line 13, "environmentally-friendly" should read -- environmentally friendly --
Line 27, "bodies" should read -- bodies. --

Column 2,
Line 4, "date" should read -- date, --
Line 4, "field" should read -- field, --
Line 5, "agents" should read -- agents, --
Line 55, "2,4dichloro-" should read -- 2,4-dicholoro- --
Line 59, "$SO_3$" should read -- $SO_3$ --
Line 59, "$CO_2$" (two occurrences) should read -- $CO_2$ --
Line 62, "—$C_{1-C6}$-alkyl—" should read -- —$C_1$-$C_6$-alkyl— --
Line 65, "never dried" should read -- never-dried --
Line 67, ""never dried"" should read -- "never-dried" --

Column 3,
Line 1, "never dried" should read -- never-dried --
Line 13, "7,5" should read -- 7.5 --
Line 14, "8,5" should read -- 8.5 --
Line 34, "two bath" should read -- two-bath --

Column 4,
Line 62, "NaoH" should read -- NaOH --

Column 5,
Line 6, "equalled" should read -- equaled --
Line 18, "Never dried" should read -- Never-dried --
Line 40, "Never dried" should read -- Never-dried --
Line 54, "Never dried" should read -- Never-dried" --

UNITED STATES PATENT AND TRADEMARK OFFICE

CERTIFICATE OF CORRECTION

PATENT NO. : 6,241,933 B1
DATED : June 15, 1999
INVENTOR(S) : Köll et al.

It is certified that error appears in the above-identified patent and that said Letters Patent is hereby corrected as shown below:

Column 6,
Line 10, "respectively" should read -- and --
Line 20, "bodies" should read -- bodies; --
Line 34, "whereby" should read -- wherein --
Line 35, "compound" should read -- compound; and --
Line 44, "never dried fibres." should read -- never-dried fibres. --

Signed and Sealed this

Twenty-eighth Day of May, 2002

*Attest:*

*Attesting Officer*

JAMES E. ROGAN
*Director of the United States Patent and Trademark Office*